United States Patent [19]

Keyworth et al.

[11] Patent Number: 4,540,839

[45] Date of Patent: Sep. 10, 1985

[54] PROCESS FOR THE PRODUCTION OF POLYMER GASOLINE

[75] Inventors: Donald A. Keyworth, Houston; Cecil G. McFarland, League City, both of Tex.

[73] Assignee: Petro-Tex Chemical Corporation, Houston, Tex.

[21] Appl. No.: 593,378

[22] Filed: Mar. 26, 1984

[51] Int. Cl.[3] ..... C07C 2/04

[52] U.S. Cl. ..... 585/520; 585/510; 585/526

[58] Field of Search ..... 585/510, 520, 526

[56] References Cited

U.S. PATENT DOCUMENTS

| | | | |
|---|---|---|---|
| 3,546,317 | 12/1970 | Gislon et al. | 585/515 |
| 3,832,418 | 8/1974 | Bercik | 585/515 |
| 4,065,512 | 12/1977 | Cares | 585/508 |
| 4,215,011 | 7/1980 | Smith | 252/426 |
| 4,232,177 | 11/1980 | Smith | 585/324 |
| 4,242,530 | 12/1980 | Smith | 585/510 |
| 4,375,576 | 3/1983 | Smith | 585/510 |

FOREIGN PATENT DOCUMENTS

| | | |
|---|---|---|
| 973555 | 10/1964 | United Kingdom . |
| 2086415 | 12/1983 | United Kingdom . |

*Primary Examiner*—Curtis R. Davis

*Attorney, Agent, or Firm*—Kenneth H. Johnson

[57] ABSTRACT

Conversions of over 80 mole % of n-butenes to oligomers can be obtained with less than 15 mole % $C_{12}$ or higher oligomers by passing a predominantly $C_4$ stream containing at least 40 mole % n-butenes through an acidic cation exchange resin at LHSV 2 to 5 at temperatures in the range of 80° C. to 130° C., in liquid phase by cofeeding from 1 to 5 weight %, based on the $C_4$ stream, of methyl tertiary butyl ether, secondary butyl methyl ether, toluene or mixtures thereof.

33 Claims, No Drawings

PROCESS FOR THE PRODUCTION OF POLYMER GASOLINE

BACKGROUND OF THE INVENTION

1. Field of the Invention

The present invention relates to the production of polymer gasoline from streams containing $C_3$ to $C_4$ alkenes, in particular normal $C_3$ to $C_4$ alkenes, more specifically the invention is a process for producing polymer gasoline using an acid cation exchange resin and a catalyst modifier.

2. Related Art

Refinery streams having mixtures of $C_3$ and $C_4$ hydrocarbons, in particular large amounts of normal olefins are not of particular value, since the normal $C_3$ and $C_4$ olefins are not desirable gasoline components and their separation from the other components, such as the normal butane which is used in gasoline blending, by fractionation requires substantial equipment and energy.

There are several existing processes for contacting these streams with fixed bed catalysts to cause oligomerization of the normal olefins to produce streams of $C_7$ to $C_8$ olefins.

These processes, either because of the nature of the olefin product or nature of the catalyst (expense or special handling required) have not gained full industry acceptance. For example the phosphoric acid oligomerization of normal butene typically produces substantial amounts of the trimethyl pentenes which are not desirable as gasoline components.

The reaction of olefins to form longer chains of two or more monomer units is well known. It is well known that ethylene and other olefins can be polymerized to form relatively low molecular weight products through the use of certain organo-metallic catalyst. Broadly, these catalysts are compounds of metals of groups IV to VI of the Periodic Table of elements in combination with other compounds of metals of groups I to III. The Ziegler catalysts are representative of such catalysts and are preferably specific combinations of titanium halide and a trialkyl aluminum component, with or without other metal promoters. Other catalysts such as alkyl aluminum halides (preferably the chloride) in combination with alkyl titanium esters have also been used to carry out this reaction.

These catalysts are homogeneous in that they are soluble in the reaction medium. The catalysts are very effective, that is the reaction can easily be carried out to produce high molecular weight compounds, with the appropriate amounts of catalyst. In some instances, by using extremely low concentrations of catalyst in the reaction system, low molecular weight products may be produced, in particular dimers, trimers and tetramers.

Free radicals, carbonium ions and carbanions have also been used to promote the reaction of olefins, particularly alpha-olefins to produce polymers of high molecular weight.

The use of acid catalysts such as sulfuric acid to selectively react isoolefins in the presence of other olefins to produce lower molecular weight products, e.g., U.S. Pat. Nos. 3,546,317 and 3,832,418 is also well known. U.S. Pat. No. 4,065,512 discloses the use of perfluorosulfonic acid resin, particularly in the form of films for the polymerization of isobutene to produce dimers, trimers and higher oligomers. U.S. Pat. No. 4,071,567 discloses a two stage process for reacting methanol and isobutene, wherein an excess of isobutene is present in the second stage which results in isobutene dimerization.

UK Pat. Spec. No. 973,555 discloses the oligomerization of n-butene in an autogenous slurry. U.S. Pat. Nos. 4,215,011 and 4,242,530 disclose the use of acid cation exchange resin in a heterogenous combination reaction-distillation system for the selective dimerization of isobutene in the presence of normal butenes. The reaction is highly preferential for the reaction of isobutene with itself, although some codimer between n-butenes and isobutene are formed, and provides a means to separate isobutene from a $C_4$ stream.

UK Pat. specification No. 2,086,415 B discloses a process for the liquid phase oligomerization of $C_2$ to $C_{10}$ normal olefins using a fixed bed acid cation exchange resin.

U.S. Pat. No. 4,232,177 disclosed the production of diisobutene in a catalytic distillation by reaction isobutene in the presence of less than stoichiometric amounts of methanol at increased temperatures to favor production of the dimer over MTBE.

U.S. Pat. No. 4,375,576 discloses that in the liquid phase, for the reaction of isobutene with itself to form dimer in a stream containing n-butenes, the presence of 0.0001 to 1 mole of methyl tertiary butyl ether (MTBE) per mole of alkene, suppresses the formation of higher oligomers and codimers of isobutene and normal butenes, to maximize diisobutene production and n-butene recovery.

In carrying out the reaction of normal $C_2$ to $C_{10}$ olefins, particularly the $C_3$ and $C_4$ normal olefins using cation exchange resins, good results have been achieved as disclosed in commonly assigned U.S. patent application Ser. No. 425,106 filed Sept. 27, 1982, now U.S. Pat. No. 4,463,211, which is incorporated herein; however, catalyst life has been found to have been relatively short. The normal course of events being an observed decline in conversion at a given temperature, requiring increase of the temperature to maintain the conversion. However, increasing the temperature of the bed also shortens the catalyst life, for example, by desulfonating the sulfonated resins. It is believed that the initial drop in conversion is the result of polymer (higher oligomers) which is formed in the reaction, plugging the catalyst pores. The present invention has found that a small amount of a material which appears to function as a cosolvent to dissolve and remove the polymer, extends the life of the catalyst by allowing operation of the process at lower temperatures (at least at a slower rate of temperature increase) and improves the selectivity of the oligomerization to n-butene dimer.

SUMMARY OF THE INVENTION

The present invention is a process for producing polymer gasoline from hydrocarbon streams containing $C_4$ alkenes, wherein the major amount of said $C_4$ alkenes is normal alkenes comprising contacting the hydrocarbon stream in liquid phase with an acidic cation exchange resin at temperatures in the range of 80° to 130° C. at LHSV in the range of 2 to 5 in the presence 1 to 5 weight %, based on said stream, of a catalyst modifier of methyl tertiary butyl ether (MTBE), secondary butyl methyl ether (SBME), toluene or mixtures thereof, whereby a product stream comprising oligomers and unreacted material is produced, said oligomers being principally dimers of said normal alkenes. The useful life of said cation exchange resin is substantially greater than said process carried out in the absence of said modifier.

The expected useful life of the acid cation exchange resin in the absence of the modifier is about 40 to 60 days on stream. The modifier has extended the useful life of the catalyst to much longer periods, 120 days or more. The ultimate useful life of the catalyst according to the present process has not yet been determined. Current evaluations would indicate that the catalyst may be used indefinitely, however, other factors such as attrition, the presence of minute quantities (parts per million) of basic nitrogen catalyst poisons and the like will be expected to ultimately cause the catalyst to be replaced.

Generally the hydrocarbon feed is predominantly a $C_4$ hydrocarbon containing n-butenes as the major alkene, preferably at least 40 mole % of the hydrocarbon feed is n-butenes. The hydrocarbon feed is preferably a predominantly $C_4$ stream such as produced from a catalytic cracker and may contain a substantial amount of propylene, higher boiling materials having been previously removed. Normally such stream may contain only small amounts of $C_5$. A preferred hydrocarbon feed may be characterized as a substantially $C_3$ to $C_4$ hydrocarbon stream containing propylene, least 50 mole % $C_4$'s of which at least 50 mole % will be normal alkenes, more preferably the $C_4$'s will comprise at least about 70 mole % of the stream and the normal alkenes at least 80 mole % of the $C_4$'s. Isobutene is not detrimental to the process, however, it is normally removed from the $C_4$ streams, since it has greater value for example for the production of MTBE (octane improver). A preferred feed to the present process is a refinery cut which has been processed to remove isobutene and isobutane or the by-product of a process to produce MTBE (i.e., isobutene having been removed by the selective reaction of methanol and isobutene this stream may contain substantial isobutane).

The modifier, i.e, MTBE, secondary butyl methyl ether toluene or a mixture thereof is preferably employed in amounts of up to about 2 weight percent of the hydrocarbon stream. These materials each improve the life of the catalyst. It is believed that the modifier extends the life of the catalyst by suppressing polymer formation, (2) removing polymer that forms from the active sites, and/or (3) preventing the polymer from attaching to the active sites of the catalyst, however, these are proposed mechanisms and are not intended to limit the scope- of the invention.

Polar modifiers such as MTBE are also observed to favorably effect the selectivity by shifting the selectivity toward dimer production, thereby reducing $C_{12}$ and higher oligomers in the product. For gasoline blending purposes up to about 15 weight % $C_{12}$ oligomer can be tolerated, preferably the $C_{12}$ oligomers are reduced to the lowest level possible. MTBE reduces the level of $C_{12}$ and higher oligomers to less than 15 mole % when used in the ranges specified, particularly as a continuous feed with the hydrocarbon. Non polar modifiers such as toluene alone give an enhancement in oligomer STY (space time yield) over MTBE but do not cause a favorable shift in selectivity in the product distribution. However, the lower cost and availability of toluene in refineries may make its use desirable in some situations, for example, a blend of MTBE and toluene can provide economy and a portion of the benefits of MTBE alone. Secondary butyl methyl ether is an isomer of MTBE, which does not have octane improving characteristics, but will have the beneficial effect of MTBE in the present process.

The relative proportions of the various modifiers in mixtures may vary, since a similar effect is achieved with each, however, sufficient ether (MTBE and/or SBME) should be used to obtain the acidity leveling effect of the catalyst and reduction of $C_{12}$ oligomer. This may require some routine experimentation for each stream and the specific set of conditions selected, but 1–3 vol % of MTBE and/or SMBE, based on total stream volume, has been demonstrated to be effective.

The pressure is not critical however, it must be sufficient to maintain the reactants in liquid phase during the reaction.

In one embodiment of the present invention the SBME is recovered and recycled to the reaction where it performs in the same manner as MTBE. SBME may also be recovered from MTBE processes and utilized in place of MTBE, since it has no particular value otherwise.

In another embodiment the catalyst bed is treated with the modifier alone in liquid phase under the conditions of reaction. This would appear to obtain the benefits of polymer removal from cofeeding the hydrocarbon and modifier and may be desirable if the catalyst is severely deactivated. The disadvantage is the use of substantial quantities of materials which may have greater value, as for example in the case of of MTBE, and the space time yield is lowered until the MTBE is flushed out down to levels approaching 3 vol %.

Although the modifier need not be fed continuously (the non continuous or alternate feeding of modifier takes advantage of the beneficial effect of the modifier and the temporary resurgence of the catalyst effectiveness observed after termination of the modifier), it is preferred that the modifier be continuously fed.

A particular advantage of the present process is that conversion of n-alkenes of 80 mole % may be obtained in a single pass through the reactor. The higher conversions are obtained by the use of longer reactors or reactors in series (which in effect is merely a longer reactor). In the absence of the present modifiers, however, these same beds will not provide high selectivity to n-alkene dimer, and do not achieve the desired high conversions without rapid temperature degradation.

The temperature in the catalyst bed need not be uniform along its entire length, although within the range recited. For example, the down stream portion of the bed may operate at a higher temperature than the first part of the bed to obtain the high conversions.

DETAILED DESCRIPTION OF THE INVENTION

The catalysts useful for the present invention are preferably in the macroreticular form which has surface areas of from 20 to 600 square meters per gram. Catalysts suitable for the present process preferably are cation exchangers, which contain sulfonic acid groups, and which have been obtained by polymerization or copolymerization of aromatic vinyl compounds followed by sulfonation. Examples of aromatic vinyl compounds suitable for preparing polymers or copolymers are: styrene, vinyl toluene, vinyl naphthalene, vinyl ethylbenzene, methyl styrene, vinyl chlorobenzene and vinyl xylene. A variety of methods may be used for preparing these polymers; for example, polymerization alone or in admixture with other monovinyl compounds, or by crosslinking with polyvinyl compounds;

for example, with divinyl benzenes, divinyl toluenes, divinylphenylethers and others. The polymers may be prepared in the presence or absence of solvents or dispersing agents, and various polymerization initiators may be used, e.g., inorganic or organic peroxides, persulfates, etc.

The sulfonic acid group may be introduced into these vinyl aromatic polymers by various known methods; for example, by sulfating the polymers with concentrated sulfuric acid or chlorosulfonic acid, or by copolymerizing aromatic compounds which contain sulfonic acid groups (see e.g., U.S. Pat. No. 2,366,007). Further sulfonic acid groups may be introduced into these polymers which already contain sulfonic acid groups; for example, by treatment with fuming sulfuric acid, i.e., sulfuric acid which contains sulfur trioxide. The treatment with fuming sulfuric acid is preferably carried out at 0° to 150° C., and the sulfuric acid should contain unreacted sulfur trioxide after the reaction. The resulting products preferably contain an average of 1.3 to 1.8 sulfonic acid groups per aromatic nucleus. Particularly, suitable polymers which contain sulfonic acid groups and are copolymers of aromatic monovinyl compounds with aromatic polyvinyl compounds, particularly divinyl compounds, in which the polyvinyl benzene content is preferably 1 to 20% by weight of the copolymer (see, for example, German Patent Specification No. 908,247).

The preferred catalyst is one which is thermally stabilized. Varying degrees of stabilization have been obtained by the incorporation of electron withdrawing groups, particularly halogens, such as bromine and chlorine into the resin polymer. U.S. Pat. Nos. 3,256,250; 3,342,755; 4,269,943 and British Pat. No. 1,393,594 describe several such procedures.

A preferred stabilized catalyst of this type is that described in U.S. Pat. No. 4,269,943, wherein chlorine or bromine are added to the polymer prior to sulfonation. In this manner the halogen is attached to the aromatic nuclei of the resin polymer. A particularly preferred form of this catalyst is the chlorine stabilized catalyst.

The thermal stability may also be obtained by attachment of $-SO_3H$ groups at the para position to the divinyl benzene and ethylstyrene units (the ethyl and/or vinyl groups being attached in the meta position relative to each other). This is discussed in an article by Leonardus Petrus, Elze J. Stamhuls and Geert E. J. Joosten, "Thermal Deactivation of Strong-Acid Ion-Exchange Resins in Water", Ind. Eng. Chem. Prod. Res. Dev. 1981, 20, pages 366–377.

The ion exchange resin is preferably used in a granular size of about 0.25 to 2 mm, although particles from 0.15 mm up to about 2 mm may be employed. The finer catalysts provide high surface area, but also result in high pressure drops through the reactor. The increased pressure drop as a result of the smaller granular size, may be offset by using shorter reactor tubes, i.e., from about 2 to 4 ft. long. However, catalyst particles of the preferred size and substantially free of fines are not subject to the large pressure drops. The preferred granular size is 15 to 40 mesh (approximately 0.420 to 1.3 mm), which is substantially free of fines. At the LHSV's of the present invention the preferred granular size can be used in longer tubes, i.e., six to seven feet without excessive pressure drops, i.e., less than 50 psig.

The life of the catalyst can also be adversely affected by catalyst poisons. The feed to the reactor should be free of any poisons, which include cations, particularly metals, and amines.

The catalyst is employed in a fixed bed with a flow of hydrocarbon stream therethrough. The fixed bed may be in a single continuous bed with heat exchange means located therein or more preferable the reactor is a tubular reactor wherein a plurality of tubes of ⅛ to 2 inches outside diameter are mounted in a shell. The catalyst is loaded in the tubes and heat exchange medium at the desired temperatures passes through the shell and around the tubes.

The hydrocarbon feed may also contain some water, which is usually residual as the result of prior processing. Normally the water is present in up to the saturation point of the hydrocarbon. The pressure of water is not detrimental in present process which is a distinct advantage over some of the other polymer gas processes which must have substantially anhydrous feeds.

Various feed compositions utilized in the present process have produced polymer gasoline (after debutanizing) of very good octane number for use in blending or as a gasoline stock per se, e.g., RON of 93.8–94.8 and MON of 79.7–82.5. TABLE I shows typical product distribution of a stream processed without modifier and with each modifier at approximately the same levels. The toluene has a less desirable distribution but excellent conversion at moderate temperature. The greater benefit derived from MTBE is attributed to an acidity leveling effect whereby the MTBE in some fashion is associated with the active sites (toluene does not appear to have this leveling effect). In operation, beginning the MTBE feed to the reaction results in a drop in conversion which requires an increase in temperature. Similarly cessation of the MTBE initially produces an improved conversion, followed by a decline caused by polymer fouling. The MTBE appears to have a passivating effect on the catalyst.

A fouled catalyst may be brought back up by reintroducing the modifier and some operations could involve alternating the reaction alternately with and without modifier, that is, modifier need not be fed continuously, although it is preferable to do so.

It should be appreciated that MTBE, SBME, and toluene are all acceptable in gasoline, hence, a separation of the residuals in the product stream is not required. However, as described above, it may be desirable to recover SBME and recycle it to the present process, since it does not improve the octane number of gasoline and its presence must be considered in calculating the allowable oxygenated compound in the motor fuel gasoline.

The following examples are intended to illustrate the invention and not to limit its scope.

EXAMPLE 1

A charge (25 cc) of fresh methanol wetted acidic cation exchange resin (Rohm and Haas amberlyst 252-H, macro reticular resin of sulfonated styrene divinyl benzene copolymer) was loaded into a ½ inch diameter isothermal reactor. The feed tank was pressured to 180 psig with nitrogen. Liquid feed was pumped with a Milton Roy mini-pump through a 5 foot section of coiled ⅛ inch diameter stainless steel tubing, used to preheat the feed. After passing through the preheat zone, the feed entered the catalyst bed contained in an appropriate length of ½ inch O.D. steel tubing, used as the reactor. Both the reactor and preheater were immersed in a constant temperature water bath. The pressure of the reaction was maintained by a back-pressure regulator.

The length of ½ inch tubing to contain 25 cc of catalyst is 159 cm. The reaction product was collected in tared, capped weighing bottles, and analyzed by gas chromatograph.

Methanol-wetted 252-H resin was charged to the reactor, and the temperature was maintained at 85° C., 3 LHSV and 500 psig while methanol was pumped for 17 hours over the catalyst. The feed to the reactor was then changed.

The resin was stabilized by operating for a week with no modifier and at bath/bed exotherm temperatures of 82°/89° C. on a feed of about 80% n-butene the balance being primarily n-butane, at an LHSV of 3. Conversion was 38% on the seventh day with a selectivity of 88% to octene and 12% to dodecene. On the ninth day, MTBE cofeed was begun at 3/0.117 LHSV ratio hydrocarbon/MTBE and to maintain a 38.3% conversion, the temperature was increased to 91°/97° C. Based on prior data a temperature range of 1° C./3 days is more typical of the temperature increase required to maintain conversion for operations without modifier. The difference is attributed to the MTBE leveling effect on the resin's acidity. Eight days after beginning MTBE feed, 1° C. additional temperature was sufficient to give a conversion of 43.6%; and on the ninth day after MTBE was introduced, a 51% conversion was achieved with a 93°/99° C. temperature. Stabilization is attributed to a gradual flushing out of polymer blocking active sites (within resin pores). Previous results showed when the MTBE was discontinued the conversion first improved (solvent leveling effect) and then deteriorated (polymer fouling). After 30 days in use with MTBE cofeed, conversions of 45% were maintained at 96°/104° C., showing excellent resin stability. Studies without modifier to achieve higher conversions (than 30%) through temperature increase show that such rapid temperature increases to achieve the desired conversions are needed that the resin is short lived. With MTBE modifier a % conversion of 45 can be sustained with a much improved resin life over that found where no modifier is used and only a 30% C is sustained. Further, higher conversions of 50% are normally associated with poorer selectivities.

Where toluene is used as a modifier, at conversions of 45%, selectivity to octenes is less than 80%; about 20% selectivity to dodecenes, and 2% selectivity to hendecenes is observed. Achieving these high conversions thermally is also associated with poor selectivity. However, where MTBE is used as a modifier (probably because of the leveling effect on catalyst acidity) selectivity to octenes is typically 93%, and no dodecene is observed. Where the oligomer is to be used as a gasoline blending stock, dodecenes are undesirable because they are high boiling and the ones made have poor octane blending properties.

The specific results of a 30 day run are set out in TABLE II.

EXAMPLE 2

Using the same reactor as described in Example 1, 100 cc of "spent" catalyst from a different process was loaded into the reactor. The catalyst was Rohm and Haas Amberlyst XE 386, a high temperature stabilized sulfonated styrene divinyl benzene copolymer. The catalyst was lined out by running the same feed (about 80% n-butene) through the catalyst at LHSV 3, 90° C. for seven days at which time conversion of n-butene was about 25% with selectivity to the $C^{=}_{8}$ of 94% and $C^{=}_{12}$ about 6%.

MTBE was introduced and at an LHSV ratio of hydrocarbon feed/MTBE of 3/0.11 the conversion was about 32% with 82% selectivity to $C^{=}_{8}$ and 4% selectivity to $C^{=}_{12}$ termination of MTBE resulted in an increase of conversion to 85% ($C^{=}_{8}$% S=81, $C^{=}_{12}$% S=12) which gradually drifted down to 32% conversion over a 5 day period (Bath temp 91° C.). MTBE alone was fed through the bed at LHSV 3.75 and 93° C. for 18 hours, thereafter the hydrocarbon feed was resumed at the LHSV ratio HC/MTBE 3/0.11 and an average conversion of about 40% ($C^{=}_{8}$% S=96 ave.; $C^{=}_{12}$% S=3.4 ave.) for 4 days.

The MTBE was replaced with toluene at the same LHSV ratio for 6 days at 50–60% conversion (Bath temp 95°–100° C.). Selectivity to $C^{=}_{8}$ was around 80% and selectivity to $C^{=}_{12}$ around 20% during the period.

The toluene was terminated and replaced with methanol at the same LHSV ratio at 106° C. bath temperature, conversion was 4%, at 109° C. it was 3%.

EXAMPLE 3

In this example two reactors in series were employed to extend the bed depth. Both reactors contained amberlyst 252 H previously used in laboratory studies. The modifier was MTBE at 0.08 LHSV, hydrocarbon (about 80% n-butene) at LHSV 3. Both reactors were ½ inch diameter tubing containing 100 cc of catalyst. The first reactor was maintained at 91° C. bed and 106° C. bath with a conversion of n-butene of 50% at 81% selectivity to octenes. This stream entered the second reactor which was operated as shown below:

| TEMP °C. Bath/Bed | n-Butene % C | Oligomer % S C8 | C12 | C16 | Days in ser. |
|---|---|---|---|---|---|
| 102/110 | 72 | 82 | 17 | 1 | 7 |
| 102/109 | 68 | 83 | 16 | 1 | 10 |
| 103/110 | 70 | 80 | 19 | 1 | 11 |

TABLE I

| Modifier: | None Mole % | Toluene Mole % | | MTBE Mole % | |
|---|---|---|---|---|---|
| Isomer* | | | | | |
| Secondary Butyl Methyl Ether | 0 | 0 | 0 | app. 11 | app. 11 |
| Dimer I | <0.1 | <0.1 | <0.1 | 0.3 | 0.1 |
| Dimer II | 1.8 | 0.4 | 1.8 | 4.1 | 0.3 |
| 2, 5-dimethyl hexene | 3.1 | 3.1 | 2.9 | 3.4 | 2.9 |
| Toluene | 0 | app. 8 | app. 8 | 0 | 0 |
| 3, 4-dimethyl hexene | 2.2 | 2.1 | 2.1 | 1.4 | 5.8 |
| (Cis) 3,4-dimethyl hexene | 10.7 | 8.7 | 9.9 | 8.4 | 8.6 |
| (Trans) 3,4-dimethyl hexene | 30.7 | 28.5 | 28.2 | 24.0 | 24.2 |
| 4-methyl heptene | 0 | 0 | 0 | 9.2 | 7.8 |
| 3,4-dimethyl hexene | 7.3 | 6.1 | 6.7 | 6.7 | 6.9 |
| 2-methyl heptane | 7.1 | 5.9 | 6.3 | 6.6 | 6.5 |
| Octene | 2.8 | 2.5 | 2.3 | 1.7 | 1.9 |
| C12 | 12.5 | 24 | 22 | 3.7 | 6.7 |
| Conversion | 35.7 | 45.8 | 47.2 | 35.6 | 42.3 |
| Selectivity (Total C8's) | 87.5 | 76 | 78 | 96.3 | 93.3 |
| CONDITIONS | | | | | |
| Temperature °C. bath/bed | 85/93 | 85/93 | 86/95 | 95/101 | 96/103 |
| LHSV (Feed/Modifier) | 3.0 | 3.0/0.1 | 3/0.1 | 3/0.1 | 3/0.1 |
| Days (R & H 252-H | 7 days | 7 days | 9 days | 28 days | s 30 days |

TABLE I-continued

| Modifier: | None Mole % | Toluene Mole % | MTBE Mole % |
|---|---|---|---|
| Resin) | | | 10/19 |

*Debutanized bases; not all minor isomers are included.

TABLE II

| Temp Bath/Bed °C. | Days | % C | Olefin Selectivity MOLE % C8 | C12/C16 | LHSV MTBE |
|---|---|---|---|---|---|
| Feed = 3.0 LHSV 81.41% n-butene feed | | | | | |
| 88/90 | 1 | 27.1 | 84.5 | 15.5 | 0 |
| 94/96 | | 66.0 | 92.0 | 28 | 0 |
| 91/108 | 1 | 76.6 | 73.5 | 26 | 0 |
| 85/93 | | 67.9 | 73.5 | 20.7/5.8 | 0 |
| 82/89 | | 48.4 | 85.2 | 14.3/0.5 | 0 |
| 80/86 | 2 | 29.3 | 90.0 | 10 | 0 |
| 80/85 | 3 | 28.2 | 91.5 | 8.5 | 0 |
| 83/91 | 4 | 39.4 | 83.3 | 16.7 | 0 |
| 83/91 | 7 | 38.4 | 88.0 | 12.0 | 0 |
| Feed = 79.2% n-butene with MTBE Cofeed 3.0/0.117 LHSV | | | | | |
| 91/97 | 9 | 38.3 | 88.6 | 11.4 | 0.117 |
| 91/98 | 10 | 38.8 | 93.0 | 7.0 | 0.11 |
| 92/97 | 14 | 31.8 | 93.5 | 6.5 | 0.108 |
| 92/98 | 15 | 43.6 | 91.0 | 9 | 0.102 |
| 93/99 | 16 | 51.0 | 91.3 | 8.7 | 0.103 |
| Feed ran out; 24 hrs. of MTBE only; n-butene feed back on with MTBE cofeed | | | | | |
| Feed = 79.2% n-butene with MTBE Cofeed 3.0/0.1 | | | | | |
| 93/100 | 21 | 45.2 | 90.0 | 10 | 0.10 |
| 93/99 | 22 | 46.0 | 92.0 | 8 | 0.10 |
| 93/100 | 23 | 41.0 | 89.0 | 10.6 | 0.10 |
| 93/101 | 24 | 39.4 | 90.7 | 9.3 | 0.10 |
| 94/103 | 25 | 42.2 | 94.0 | 6 | 0.10 |
| 95/101 | 28 | 35.6 | 96.3 | 3.7 | 0.1 |
| 97/105 | 29 | 44.2 | 93.0 | 7 | 0.1 |
| 96/103 | 30 | 42.3 | 93.3 | 6.7 | 0.1 |
| 96/104 | | 45.5 | 91.2 | 8.8 | 0.1 |

The invention claimed is:

1. A process for producing polymer gasoline comprising contacting a hydrocarbon stream substantially free of isobutene containing at least 40 mole % normal $C_4$ alkenes, in liquid phase with an acidic cation exchange resin at a temperature in the range of 80° C. to 130° C. at LHSV in the range of 2 to 5 in the presence of 1 to 5 weight %, based on said hydrocarbon stream, of a catalyst modifier of methyl tertiary butyl ether, secondary butyl methyl ether, toluene or mixtures thereof, whereby a product stream is produced comprising oligomers and unreacted material said oligomers being principally dimers of said normal alkenes.

2. The process according to claim 1 wherein said hydrocarbon stream is predominantly $C_4$'s.

3. The process according to claim 1 wherein said hydrocarbon stream is a substantially $C_3$ and $C_4$ hydrocarbon stream containing propylene, at least 70 mole % $C_4$'s of which at least 80 mole % are normal alkenes.

4. The process according to claim 1 wherein up to 2 weight %, based on said hydrocarbon stream, of said modifier is present.

5. The process according to claim 1 wherein said modifier is methyl tertiary butyl ether.

6. The process according to claim 1 wherein said modifier is secondary butyl methyl ether.

7. The process according to claim 1 wherein said modifier is toluene.

8. The process according to claim 1 wherein said modifier is a mixture of methyl tertiary butyl ether, secondary butyl methyl ether and toluene.

9. The process according to claim 1 wherein said modifier is a mixture of methyl tertiary butyl ether and toluene.

10. The process according to claim 1 wherein said modifier is a mixture of methyl tertiary butyl ether and secondary butyl methyl ether.

11. The process according to claim 1 wherein said modifier is a mixture of secondary butyl methyl ether and toluene.

12. the process according to claim 1 wherein said product stream contains less than 15 mole % $C_{12}$ oligomers.

13. The process according to claim 1 wherein said modifier is fed continuously.

14. The process according to claim 1 wherein said modifier is fed intermittently.

15. The process according to claim 1 wherein said acidic cation exchange resin is contacted with said modifier in the absence of a hydrocarbon stream at an LHSV of 2 to 5 at a temperature in the range of 80° C. to 130° C.

16. The process according to claim 1 wherein the conversion of normal alkenes is 80 mole % or greater.

17. The process according to claim 16 wherein there are different temperature zones in said acidic cation exchange resin.

18. The process according to claim 17 wherein the temperature in said catalyst bed is higher down stream.

19. A process for producing polymer gasoline comprising contacting a hydrocarbon stream containing $C_4$ alkenes, wherein the major amount of said $C_4$ alkenes is normal alkenes in liquid phase with an acidic cation exchange resin at a temperature in the range of 80° C. to 130° C. at LHSV in the range of 2 to 5 in the presence of 1 to 5 weight %, based on said hydrocarbon stream, of a catalyst modifier of toluene, a mixture of methyl tertiary butyl ether, secondary butyl methyl ether and toluene, a mixture of methyl tertiary butyl ether and toluene or a mixture of secondary butyl methyl ether and toluene, whereby a product stream is produced comprising oligomers and unreacted material said oligomers being principally dimers of said normal alkenes.

20. The process according to claim 19 wherein said hydrocarbon stream is predominantly $C_4$'s.

21. The process according to claim 19 wherein said hydrocarbon stream is a substantially $C_3$ and $C_4$ hydrocarbon stream containing propylene, at least 50 mole % $C_4$'s of which at least 50 mole % are normal alkenes.

22. The process according to claim 21 wherein said hydrocarbon stream comprises at least 70 mole % $C_4$'s of which at least 80 mole % are normal alkenes.

23. The process according to claim 19 wherein up to 2 weight %, based on said hydrocarbon stream, of said modifier is present.

24. The process according to claim 19 wherein said modifier is toluene.

25. The process according to claim 19 wherein said modifier is a mixture of methyl tertiary butyl ether, secondary butyl methyl ether and toluene.

26. The process according to claim 19 wherein said modifier is a mixture of methyl tertiary butyl ether and toluene.

27. The process according to claim 19 wherein said modifier is a mixture of secondary butyl methyl ether and toluene.

28. The process according to claim 19 wherein said product stream contains less than 15 mole % $C_{12}$ oligomers.

29. The process according to claim 19 wherein said modifier is fed continuously.

30. The process according to claim 19 wherein said modifier is fed intermittently.

31. The process according to claim 19 wherein the conversion of normal alkenes is 80 mole % or greater.

32. The process according to claim 31 wherein there are different temperature zones in said acidic cation exchange resin.

33. The process according to claim 32 wherein the temperature in said catalyst bed is higher down stream.

* * * * *